United States Patent [19]

Preisler et al.

[11] 4,312,139

[45] Jan. 26, 1982

[54] MATERIAL WEB DRIER

[75] Inventors: Erich Preisler; Karl Bilek; Reinhard Pinter; Rudolf Greimel; Milada Weinmann, all of Graz; Herbert Holik, Ravensburg; Guntram Feurstein, Grünkraut, all of Fed. Rep. of Germany

[73] Assignee: Escher Wyss GmbH, Ravensburg, Fed. Rep. of Germany

[21] Appl. No.: 161,747

[22] Filed: Jun. 23, 1980

[30] Foreign Application Priority Data

Jul. 2, 1979 [AT] Austria ..... 4599/79

[51] Int. Cl.[3] ..... F26B 13/02; F26B 21/12

[52] U.S. Cl. ..... 34/54; 34/155; 34/156; 239/437; 239/562

[58] Field of Search ..... 239/437, 451, 455, 562; 34/155, 156, 54

[56] References Cited

U.S. PATENT DOCUMENTS 3,621,586 11/1971 Meyer ..... 34/155
3,930,319 1/1976 Coleman ..... 34/155
3,995,375 12/1976 Weinmann ..... 34/155

FOREIGN PATENT DOCUMENTS 233941 10/1963 Austria .
308524 7/1973 Austria .
953248 3/1964 United Kingdom .

*Primary Examiner*—Larry I. Schwartz
*Attorney, Agent, or Firm*—Werner W. Kleeman

[57] ABSTRACT

A material web drier containing a device for controlling the gas flow of a drying medium as a function of the actual state of the wet material web which is to be dried, comprising nozzle casings or surfaces containing blow-out or discharge openings arranged in cooperating relationship with respect to the material web. The discharge openings are directed towards the material web and serve for blowing-out the drying medium onto the web. For the purpose of dosing the gas flow or stream effluxing at the nozzle casings or surfaces, there are provided opening and closing elements which free the discharge openings or partially or completely close the same, as desired, whereby it is possible to vary the impingement of the material web by the drying medium selectively at discrete locations or regions thereof, both in the lengthwise and transverse directions of such material web.

19 Claims, 18 Drawing Figures

MATERIAL WEB DRIER

BACKGROUND OF THE INVENTION

The present invention relates to a new and improved construction of a material web drier which is of the type containing a device for controlling the gas flow or stream of a drying medium as a function of the actual condition of the material web which is to be dried.

Generally speaking, the material web drier of the invention is of the type comprising surfaces arranged in coacting relationship with respect to the material web and provided with blow-out or discharge openings, especially constructed in the form of air infeed lines structured as nozzle casings or boxes having openings directed towards the material web and serving for the discharge of the drying medium, there being provided intermediate spaces or interstices formed by the nozzle casings arranged in spaced relationship from one another in order to enable drawing or sucking-off of the drying medium.

Such general type of prior art material web drier has been disclosed in U.S. Pat. No. 3,995,375, granted Dec. 7, 1976. Also in U.S. Pat. No. 3,930,319, granted Jan. 6, 1976 there is disclosed a drying apparatus for drying a traveling web, particularly a paper web, wherein a hot air delivery structure is mounted in coacting relationship with a steam heated cylinder to direct jets of hot air against the traveling web supported upon the cylinder. Also known in this technology is a drying hood, as disclosed in British Pat. No. 953,248, published Mar. 25, 1964, wherein such drying hood fits around a drying cylinder of a papermaking machine for the purpose of drying the fabricated paper web. A still further construction of drying apparatus is disclosed in Austrian Pat. No. 233,941, granted June 10, 1964.

As is well known, it is the purpose of a material web drier to render possible an effective delivery of the drying medium to the material web and to again draw-off such drying medium. During this drying process moisture is delivered by the material web to the drying medium and then the drying medium laden with the picked-up moisture is withdrawn.

It is well known when processing web or sheet-like materials, such as paper webs, to remove the moisture from such materials with the aid of a drying medium. To this end, the drying medium, during such time as the material web is continuously moved upon a suitable conveying device, is blown onto the material web by means of discharge or outflow channels and again withdrawn by means of further channels. There have been used for this purpose so-called nozzle casings or discharge surfaces and by means of discharge openings for the drying medium, which are directed onto the material web, the drying medium is blown onto such material web. By means of special outflow or withdrawal openings the drying medium which is enriched with the moisture removed from the treated material is again sucked-off. Particularly significant in this regard is the aforementioned U.S. Pat. No. 3,995,375.

As a general rule, the discharge openings are structured as bores, but however they can also be formed as slots which can be designed in the most different variations. The purpose of such discharge openings, whether they are slots, bores or otherwise, is to always have the drying medium impinge as uniformly as possible over the material web, in order to realize a uniform drying characteristic of the treated material.

It is also known to the art, especially from Austrian Pat. No. 308,524, granted Oct. 15, 1972, to provide a drying apparatus with discharge or blow-out openings for the drying medium such that the drying medium does not only linearly impact against the material web, rather strikes the material web at an inclination through a certain angle. To prevent resucking-up of the drying medium directly at the preceding discharge opening, it is also known to use a discharge location as an air curtain.

Also there is known a method by means of which there can be controlled the moisture characteristic or profile of paper during its fabrication. Hence, at a number of locations of the material web there is measured the moisture content. With the aid of control signals, formed as a function of the thus measured moisture content, two of such control signals are employed for controlling the lateral bearing of the material web at the pressure roll in order to reduce changes in the moisture profile. A third control signal is used for the uniform change in the moisture content of the material web. By means of this method for controlling the moisture profile during paper fabrication, it is intended to insure that certain residual moisture, which is formed at a number of regions of the material web more intensely than at other regions, is compensated.

Yet, these measures are associated with the drawback that there are required complicated devices, in order to obtain a change in the profile of the moisture content. The problem really is not attacked at its root, since the drying medium is uniformly applied to the material web, and thus, there cannot be taken into account any influence upon possibly formed moisture zones.

SUMMARY OF THE INVENTION

Therefore with the foregoing in mind, it is a primary object of the present invention to provide a new and improved construction of material web drier which is not afflicted with the aforementioned drawbacks and limitations of the prior art proposals.

Another and more specific object of the present invention aims at the provision of a new and improved construction of material web drier containing a flow control device for controlling the gas stream or flow and directly acting upon the discharge or blow-out openings, so that it is possible to bring about a change in the drying intensity at any random point of the material web during the drying operation.

Still a further significant object of the present invention is directed to a new and improved construction of a material web drier arrangement which is relatively simple in construction and design, economical to manufacture, extremely reliable in operation, easy to use, not readily subject to breakdown, requires a minimum of maintenance and servicing, and wherein there can be controllably influenced the application of the drying material to discrete zones of the processed material web, in order to realize a more controlled drying of the material web.

Now in order to implement these and still further objects of the invention, which will become more readily apparent as the description proceeds, the material web drier of the present invention is manifested by the features that there is provided means coacting with the material web to be dried for infeeding a drying medium thereto. Such means comprises at least one surface means or nozzle casing or box having discharge openings through which flows the drying medium for contact with the material web. Coacting with the nozzle casing are opening and closing means which serve to free or partially or completely close, as desired, the discharge openings, in order to thereby selectively alter the impingement of the material web by the drying medium at predetermined discrete locations of the material web, both in the lengthwise direction and also the transverse direction of such material web.

In its more particular aspects the invention contemplates providing opening and closing elements at a drying medium blow-out surface or at the base of the nozzle casing in order to dose the gas flow of the drying medium, these opening and closing elements freeing or partially or completely closing the discharge or blow-out openings, in order to selectively vary in a sector-like fashion, both in the lengthwise direction as well as also in the transverse direction, the impingement of the material web by the drying medium. In order to be able to accomplish this selective impingement of the drying medium at the material web, a further construction of the invention contemplates structuring the opening and closing elements as substantially flat slides or slide means, wherein, viewed in the lengthwise direction of the slide means, upon or below the blow-out surfaces or base of the nozzle casing, a sequentially repetitive bore row of the slide means is located opposite the openings provided at the slide means. The row of bores of the slide means accomplish at a number of discrete locations, preferably at four portions of the material web over its width, a gas flow change in accordance with the momentary position of the slide means.

Due to this design of the material web drier having a control device for controlling the gas flow, there is now beneficially attained the result that the moisture profile of the material web can be governed to be essentially uniform throughout the material web, and further, there also can be effectively eliminated any possibly arising residual moisture strips or region.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
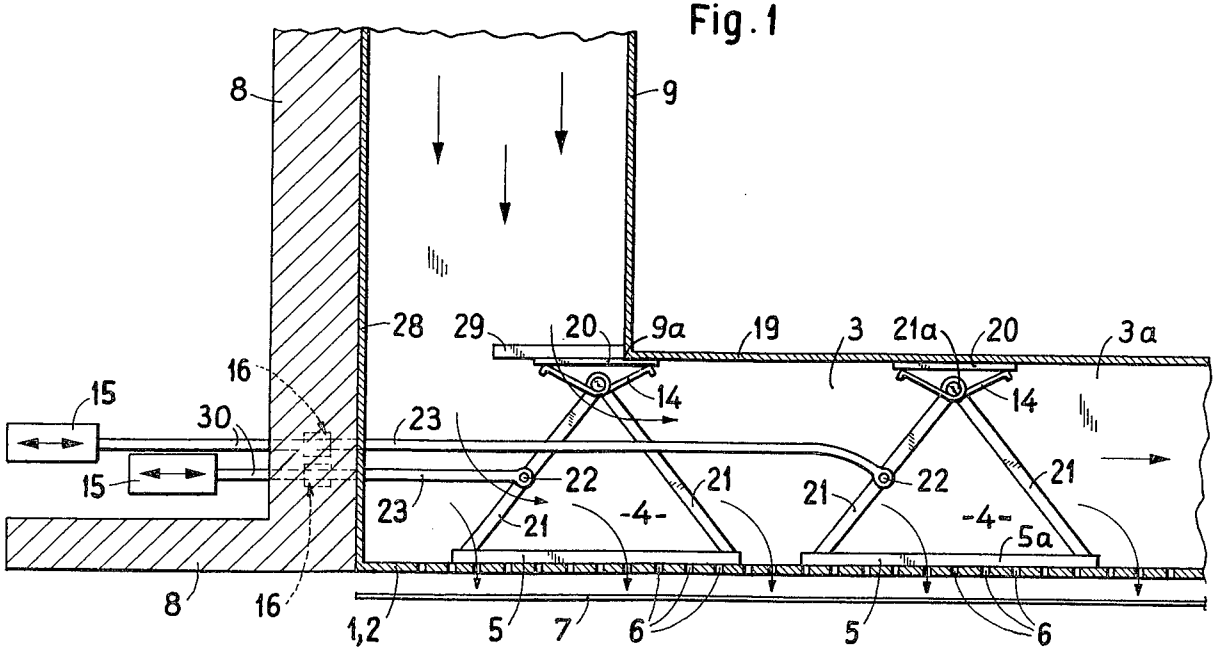
FIG. 1 is a fragmentary longitudinal sectional view of one of the nozzle casings or boxes of the material web drier arrangement of the invention.

Describing now the drawings, it is to be understood that for purposes of simplifying the illustration only enough of the construction of the material web drier or drier arrangement of the present invention has been illustrated therein as needed for one skilled in the art to readily understand the underlying principles and concepts of the present development. In FIG. 1 there is shown a longitudinal sectional view of part of one possible embodiment of material web drying installation or arrangement employing nozzle casings or boxes 3. As will be apparent to one skilled in the art, particularly in the papermaking art, when utilizing such nozzle casings the same may be positioned around the periphery of a conventional drying cylinder, such as disclosed in the aforementioned Austrian Pat. No. 308,524. Other possible forms of drying cylinder for a papermaking machine, by way of example and not limitation, have been disclosed for instance in the commonly assigned copending United States application Ser. No. 06/068,554, filed Aug. 22, 1979 of Guntram Feurstein and also the commonly assigned, copening U.S. application Ser. No. 06/068,555, filed Aug. 22, 1979 of Guntram Feurstein, each entitled "Drying Cylinder For a Papermaking Machine", to which reference may be readily had and the disclosure of which is incorporated herein by reference. When the nozzle casings or boxes 3 are used with a drying cylinder then they extend about the periphery of such drying cylinder in the lengthwise direction of the lengthwise axis of the drying cylinder and transversely with respect to the material web passing over the drying cylinder and below the nozzle casings 3. Now as best seen by referring to FIG. 1, at an upright or vertical air infeed line 9 there merges at the deflection location, generally indicated by reference character 9*a*, a horizontally extending nozzle casing or box 3. Laterally of the infeed line 9 or equivalent structure there is arranged a heat damming-up or insulating wall 8, which extends downwardly and then laterally towards the outside, as shown at the left-hand portion of FIG. 1.

Continuing, it will be seen that in cross-section the nozzle casing or box 3 can be constituted by an approximately rectangularly configured, upright profile tube or conduit, which is closed at all sides, with the exception of its end and rear walls or wall portions, at which there merges, as shown in FIG. 1, the air infeed line or arrangement 9. By means of such air infeed line 9 there is fed into the internal region or compartment 3*a* of the nozzle casing 3 a suitable drying medium, here assumed to be hot air. Furthermore, each of the nozzle casings or boxes 3 has a base or bottom 2 provided with opening or holes 6 serving as discharge or blow-out openings and directed directly upon the material web 7 which travels therebelow.

Within the nozzle casing 3, namely within the internal compartment 3*a* thereof, there are accommodated the inventive air flow-control means, constituted by suitable opening and closing elements 4 for the discharge or blow-out openings 6. In the embodiment under discussion such opening and closing elements 4 are constructed as flat slides or slide elements 5 having essentially the same width as the internal compartment 3*a* of the nozzle casing 3 and a length corresponding to somewhat less than about one-quarter of the length of the nozzle casing 3, i.e. the slide elements 5 can freely move independently of one another. Each of the flat slides 5 has a row of bores, such as the bores 11, 12 or 11 to be discussed more fully hereinafter in conjunction with the slide constructions portrayed in FIGS. 5*a* to 5*c*, FIGS. 6*a* to 6*c* and FIGS. 7*a* to 7*g*, as will be disclosed more fully hereinafter. At the upper side or face 5*a* of each slide element 5, as shown in FIG. 1, there is attached a frame or support means 21, which in conjunction with the related slide element 5 forms an approximately equilateral triangle. This upright structure, composed of the slide element 5 and the related frame 21, extends up to the upper wall 19 of the nozzle casing or box 3. At the uppermost location or end 21*a* of the frame 21 of each slide element 5 there is arranged a sliding shoe or block 20, bearing by means of a spring 14 or equivalent structure against the wall 19 of the nozzle casing 3. In this way there is insured that each slide element 5 will snugly bear against the casing base or bottom 2 which defines a blow-out surface or member 1 for such nozzle casing 3.

Each slide element 5 is displaceable in the lengthwise direction of and within the nozzle casing or box 3. By virtue of the particular arrangement of the rows of bores 11, 12 it is possible to free or partially or completely close the discharge or blow-out openings 6 at the base or floor 2 of the nozzle casing 3. At this point it is underscored that when the discharge openings 6 are freed there is realized an increased throughput of the drying medium, whereas during normal operation of the material web dryer arrangement there is carried out the usual impingement of the material web with the drying medium. In the closed position, i.e. where the slide elements 5 close the discharge openings 6, there is suppressed any discharge or blowing-out of the drying medium at such location. A practical arrangement of material web drier contemplates arranging four of such opening and closing elements 4 within a related nozzle casing or box 3, in order to thereby realize the desired regulation or adjustment of the intensity of the blown-out drying medium over the entire width of the processed material web 7.

It is also possible to arrange a different number of such opening and closing elements 4. The given size of the nozzle casings 3 and the accommodation of the adjustment elements or devices therein, generally determines the number of slide elements 5 which can be arranged in each such nozzle casing 3. At each frame 21, and preferably as close as possible to the center of gravity 22 thereof, there is arranged a coupling or actuation element 23, here shown as a coupling or actuation rod, which is guided directly through the heat insulation wall 8 and externally thereof is operatively connected with any suitable adjustment element or device 15, such as a drive motor or fluid operated piston-and-cylinder unit, by way of example and not limitation. Further, it is also to be mentioned that at the heat insulation wall 8 there is provided for each coupling rod 23 a heat dam-up or insulation element 16, in order to render more difficult the passage of heat from internally of the nozzle casing 3 towards the outside. One advantageous construction of heat dam-up or insulation element 16 will be disclosed hereinafter in conjunction with FIG. 4. At the top of the nozzle casing or box 3 there is arranged along the wall 19 a rail 29 or equivalent structure which extends past the upper wall 19, as shown in FIG. 1, and serves to insure that the sliding shoe or block 20 of the left-hand situated slide element 5 also will come to bear at that region of the nozzle casing arrangement which extends into the confines of the air infeed line 9. The element 29 is to be construed as constituting a rail or equivalent structure, not as a partition wall which would hinder the gas flow.

Figure 2:
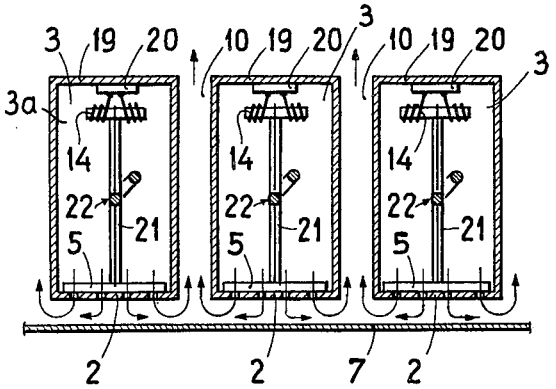
FIG. 2 is a cross-sectional view of a nozzle casing or box arrangement working in conjunction with a flat or planar material web.

Now in FIG. 2 there are shown a number of nozzle casings or boxes 3, as the same can be erected in a row adjacent and slightly spaced from one another along the path of travel of a material web 7. The nozzle casings 3 are in the form of upright rectangular boxes and are provided at the side confronting the material web 7 with the air discharge or blow-out openings 6, as the same have been discussed and shown in conjunction with the drier arrangement of FIG. 1. Arranged over the nozzle casing floor or bottom, here also designated by reference character 2, are the coacting slide elements 5. Moreover, there has also been shown the frame 21 of the related slide element 5, wherein, just as was the case for the arrangement of FIG. 1, here also the related slide shoe or block 20 bears at the upper region of the top wall 19 of the nozzle casing 3. Once again a spring 14 or equivalent structure presses the slide shoe 20 against the upper wall 19 and such, in turn, insures that the related slide element 5 will snugly bear against the casing floor or base 2. The center of gravity 22 is to be considered as simultaneously constituting the point of engagement for the here not particularly illustrated coupling element or rod 23. As mentioned, the nozzle casings 3 are arranged at a certain spacing from one another, and specifically, such that there remains therebetween an intermediate space or interstices 10. Now if the drying medium is delivered into the internal compartment 3*a* of the nozzle casing 3, then such drying medium will be forced through the discharge or blow-out openings 6 and contacts the material web 7. Following contact of the drying medium with the material web 7, such drying medium, typically as mentioned the hot air, is then again withdrawn or sucked-off through the intermediate spaces 10, the withdrawn drying medium carrying therewith the moisture which it has removed from the material web 7. However, it is also possible to provide, in place of the nozzle casings 3, a base member or element 2 provided with discharge openings 6 and serving as a blow-out surface 1.

Figure 3:
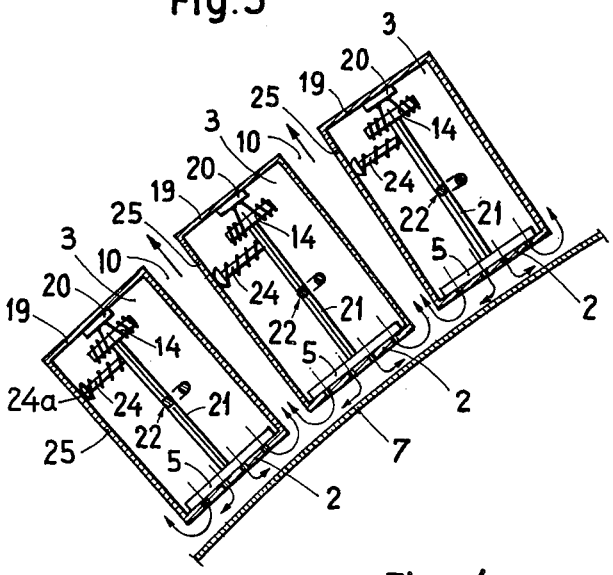
FIG. 3 illustrates a nozzle casing arrangement for use with a curved material web.

FIG. 3 shows in analogous fashion to the arrangement of FIG. 2 a number of nozzle casings or boxes 3, wherein such however are arranged at an inclination, for instance corresponding to an arrangement of nozzle casings dispositioned about a drying cylinder over which there is guided the material web 7, as previously explained. Also in this case, each of the nozzle casings 3 contains a casing floor or base 2 and at the opposite side each such nozzle casing 3 is closed by the casing wall 19. With this arrangement it is to be noted, however, that the nozzle casings which are arranged so as to be sloping or dispositioned in a non-upright fashion, are provided at their side wall 25 with an adjustable spacer element 24. The purpose of the spacer element 24 is to insure that the spring-loaded slide shoe or block 20 and the slide element 5 do not laterally slide out of their intended position. The spacer element 24 is advantageously used as a contact or support element, in order to prevent any binding or jamming of the slide element 5 within the nozzle casing 3. This spacer element 24 is adjustable by any suitable adjustment device, such as a threaded spindle, generally indicated by reference character 24*a*, but also can be accommodated by an additional spring element.

Figure 4A:
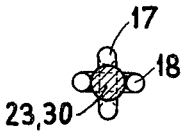
FIG. 4*a* is a detail view showing a possible construction of a heat retarding or damming-up element of the arrangement shown in FIG. 4.
Figure 4:
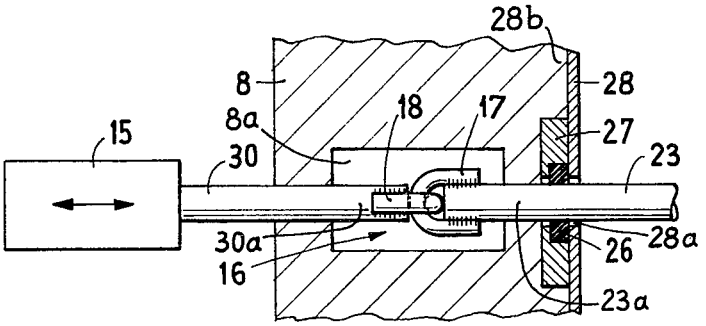
FIG. 4 illustrates in a fragmentary sectional enlarged view details of one possible construction of connection between the flat slide of a nozzle casing and an adjustment device for such slide.

FIG. 4 illustrates in an enlarged fragmentary view part of the arrangement of FIG. 1, and specifically the location where the coupling element or rod 23 is guided out of the region of the nozzle casing 3. A boundary wall 28 located adjacent the heat insulation or dam-up wall 8, contains a bore 28*a* through which passes the connecting or coupling rod 23, and at the location of the inner face 28*b* of the boundary wall 28, and specifically within the heat insulation wall 8, there is arranged a packing gland or bushing 26 for sealing the connecting or coupling rod 23. The packing gland 26 is retained in position by a fixing element 27. Moreover, the heat insulation wall 8 will be seen to be provided with a bore or recess 8*a* therein, in which there is accommodated the heat retarding or insulation element 16. This heat retarding element 16 comprises a hook member 17, which is flexed in substantially U-shaped configuration about the end 23*a* of the connecting or coupling rod 23 and is fixedly connected, as by welding, with such rod end 23*a*. A similar type of U-shaped element or eyelet 18, turned through 90° with respect to the hook element 17, is flexed about the neighboring end 30*a* of the coupling rod 30. This connection of the coupling rod portions 23, 30 with one another by means of the hook element 17 and the eyelet 18 serves the purpose of having only a point-like contact between both of these elements, so that there is blocked or at least essentially retarded the transfer of heat from the related nozzle casing 3 towards the outside. The coupling or connecting rod 30 is guided through the heat insulation wall 8 towards the outside and is operatively engaged with the adjustment device 15. As previously stated, the adjustment device 15 may be any conventional drive, and typically such is constituted by a hydraulic or pneumatic adjustment element.

FIG. 4*a* shows the position of the hook element 17 and the eyelet element 18, and specifically the manner in which such have been turned through 90° with respect to one another and welded or otherwise suitably affixed at the coupling rods 23 and 30.

Figure 5:
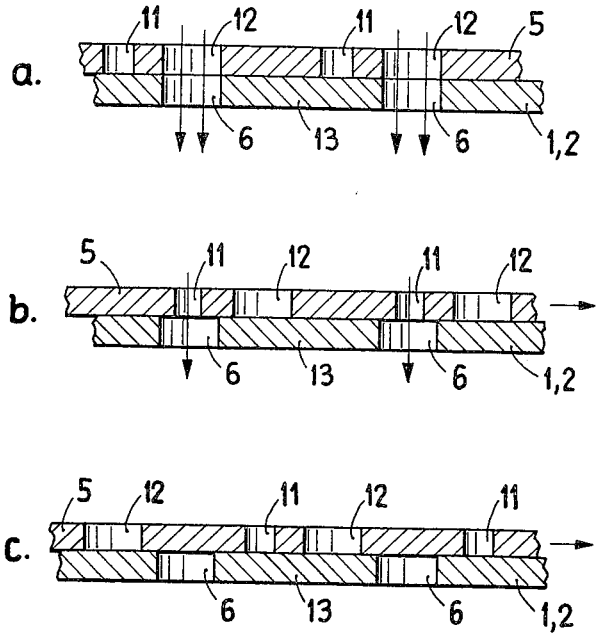
FIGS. 5*a*, 5*b* and 5*c* illustrate various possible operating positions of the flat slide or slide member provided with bores or holes of different diameter.

Now in FIGS. 5*a* to 5*c*, FIGS. 6*a* to 6*c*, and FIGS. 7*a* to 7*g*, there are shown details of different possible constructions of slides, and specifically, the manner in which the individual bores or openings may be arranged, on the one hand, at the blow-out surface 1 or casing base 2 and, on the other hand, at the slide elements 5. In the embodiment of FIGS. 5*a* to 5*c* there is shown an arrangement wherein at the slide element 5 there are provided so-called standard bores 11, which are followed, in each case, by a larger size bore or opening 12. Hence, there will be seen that there is a repetitive sequence of a smaller size bore 11, followed by a larger size bore 12, again followed by a smaller size bore 11 and so forth. At the blow-out surface 1 or at the casing base 2 there are arranged the discharge or blow-out openings 6, each of which have approximately the same diameter or size as the bores or openings 12.

In the position of the slide element 5 as shown in FIG. 5*a*, the largest air throughput quantity can flow through the bores or openings 12 and the discharge openings 6. The standard bores 11 are closed because they are covered by imperforate portions 13 of the blow-out surface 1 or casing base 2, as the case may be.

In FIG. 5*b* the slide element 5 has been shown shifted somewhat towards the right of the illustration, so that here the standard bores 11 are located in alignment with their related openings 6. In this instance, there is blown-out the so-called normal or standard quantity of drying air.

Finally, in the position of the slide element 5 as shown in FIG. 5*c*, there has been illustrated such slide element 5 shifted still further towards the right of the showing of FIG. 5*c*, so that now a normal or standard smaller size bore 11 and the larger size bore 12 each overlie the imperforate portions 13 of the blow-out surface 1 or casing base 2, as the case may be, wherefore no drying air is discharged onto the material web. In this case, the slide element 5 closes the casing base or bottom 2 or the blow-out surface 1.

Figure 6:
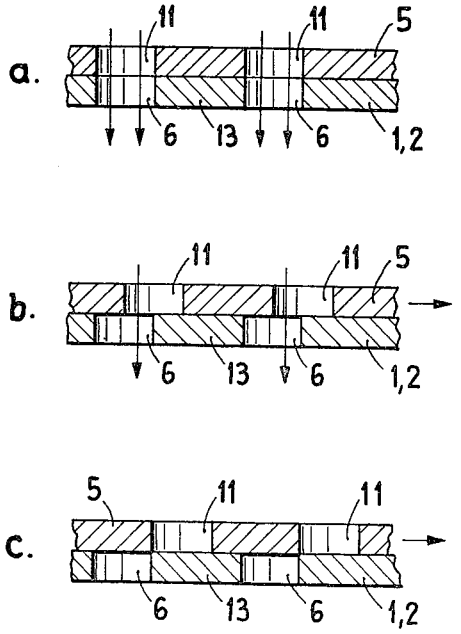
FIG. 6*a*, FIG. 6*b* and FIG. 6*c*, are fragmentary sectional views, like the showing of FIGS. 5*a*, 5*b* and 5*c*, respectively, however showing a modified construction of slide or slide member wherein all of the bores or holes thereof have the same diameter.
Figure 7:
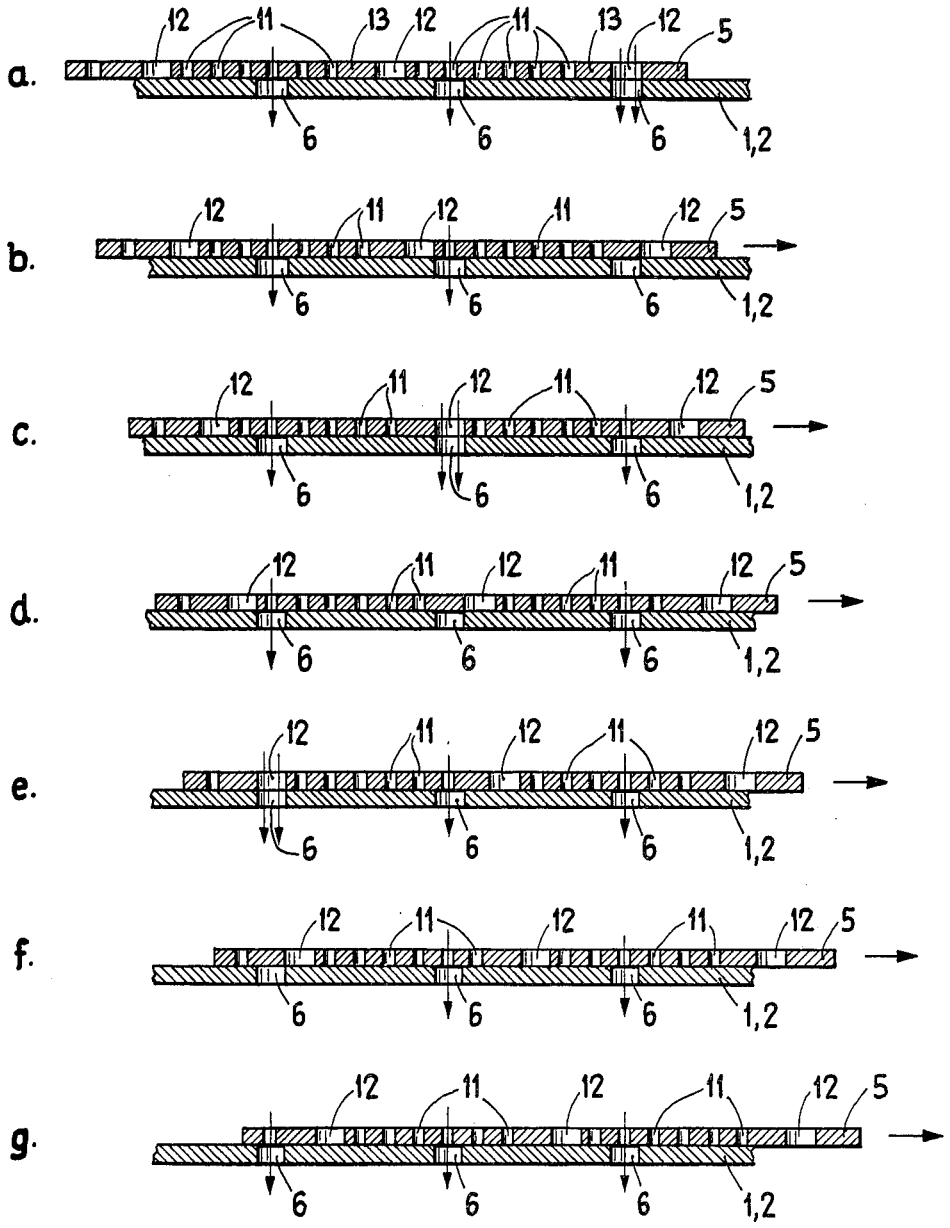
FIG. 7*a* to 7*g* illustrate various possible slide positions for a modified construction of slide member, by means of which it is possible to alter in a sector-like fashion the discharge of the drying medium through the discharge or blow-out openings of the related nozzle casing or box.

Now in the embodiment shown in FIGS. 6*a* to 6*c* there is shown a different solution, wherein there can be realized a similar effect, as described above with the embodiment of FIGS. 5*a* to 5*c*, through the use of bores 11 of the same size. At the slide element 5 there are only formed the standard or normal bores or openings 11 and such have the same size as the discharge or blow-out openings 6.

In the illustration of the slide element 5 as shown in FIG. 6*a*, each of the bores 11 is in complete registry and overlying relationship with a related one of the discharge openings 6, so that there can be expressed onto the material web a large quantity of drying air. The imperforate locations 13 are not used for blocking the air flow.

In the position of the slide element 5, as shown in FIG. 6*b*, the slide element 5 has been shifted somewhat towards the right of the showing of the drawing. Here, displacement of the slide element 5 is through a distance amounting to only about one-half of the diameter of a standard bore 11, so that only approximately one-half of the discharge opening 6 is freed for the passage of drying air therethrough. In this case the imperforate locations 13 are covered by about one-half of the related bore 11.

Finally, in the showing of the slide element 5 as positioned in FIG. 6*c*, this slide element 5 has been shifted still further to the right of the drawing, wherein now the normal or standard bores 11 come to lie over the imperforate locations 13. The discharge or blow-out openings 6 are thus completely closed. With the position of the slide element 5 as shown in FIG. 6*b* it is possible to operate the system under normal operating conditions, whereas with the position of the slide element 5 as shown in FIG. 6*a* the system is operated such that there is blown-out twice the normal quantity of drying air.

Now in FIGS. 7*a* to 7*g* there are shown various possibilities of designing a slide element 5, when there is not merely required a uniform change in the throughput of the drying medium, as with the arrangement of FIGS. 5*a* to 5*c* and FIGS. 6*a* to 6*c*, over the entire length of the nozzle casing 3, i.e. over the web width, rather there is required selective influencing of the discharge openings or apertures 6 in a discrete or sector-like fashion, i.e. the throughput of drying medium is varied at various points or locations across the width of the material web. In this case it is necessary that the discharge openings 6 of the blow-out surface 1 or the casing bottom 2 have the same diameter as the large bores 12 at the slide element 5.

Following the bores 12 there are provided, for instance, six normal or standard smaller size bores 11 which are arranged in spaced relationship from one another in a row. Thereafter there is an imperforate location 13, following which the entire bore system is again repeated, starting with the large size bore 12, as shown.

In the showing of FIG. *7a* the slide element 5 has been shifted such that the normal or standard bores 11 come to lie over the discharge openings 6 and one of the larger size bores 12 comes to lie over the last discharge opening 6. In this position there is obtained a normal throughput of drying air at the first and second discharge openings 6, whereas at the last discharge opening 6 there is possible twice the air throughput. In the arrangement shown in FIG. *7b*, the slide element 5 has been shifted such that the first two discharge openings 6 function as normally open discharge openings 6 and the last discharge opening 6 is closed, as shown.

FIGS. *7c* shows a variation wherein the slide element 5 is positioned such that the outer discharge openings 6 have blown therethrough a normal intensity of drying air, whereas only the intermediate discharge opening 6 has passing therethrough twice the normal quantity of drying air.

In FIG. *7d* there is shown a position of the slide element 5 where the latter has been shifted further towards the right, than in the showing of FIG. *7c*, and now the intermediate discharge or blow-out opening 6 is closed, whereas both the outer discharge openings 6 have passing therethrough a normal quantity of drying air.

In FIG. *7e* the slide element 5 has been positioned such that through the first discharge opening 6 there effluxes twice the normal air quantity, whereas through both of the next discharge openings 6 there flows only the normal quantity of drying air.

In FIG. *7f* the slide element 5 has been shifted still somewhat further towards the right, with the result that now there is brought about obturation of the first discharge opening 6, whereas the remaining two discharge openings 6 have lying thereover a normal or standard size bore 11, so that through these remaining two discharge openings 6 there effluxes the normal air quantity.

Finally, with the slide element 5 positioned as shown in FIG. *7g* all three of the discharge openings 6 have located thereover a related normal size bore 11, so that through each of the discharge openings 6 there flows the normal quantity of drying air.

From the discussion of FIGS. *7a* to *7g* it should be readily apparent that with this design of the slide element 5 and through appropriate displacement of such slide element 5 it is possible to realize a beneficial sector-like impingement of the material web 7 with the drying medium. It is not only possible to completely close a portion or section of the air throughflow surface or casing base through which passes the drying medium, but there also exists the possibility of obtaining an additional intensification of the applied drying medium by doubling the throughflow cross-section. When using at least four slide elements within a nozzle casing, which also can be arranged below the nozzle casing, and with the system-like rows of bores, it is possible to attain the beneficial result that there can be realized a sector-like change in the impingement of the material web by the drying air, both in the lengthwise direction of the material web as well as also in the transverse direction thereof, as desired, by partially or completely closing or freeing the discharge openings. Of course, the same bore system of the slide element 5 can be arranged in the casing base 2 or the blow-out surface 1, if there are preferred the use of the same bores in the slide element 5. The coupling elements or coupling means 23, 30 which are laterally guided out of the heat insulating wall 8, enable independent displacement of the related slide element through the action of the adjustment device 15. Hence, the slide elements 5 can be easily mechanically adjusted. Usually however there is provided a particular regulation device which is not subject matter of the present invention and therefore need not here be further considered. It would be possible to provide feelers or sensors at different locations of the width of the material web, these sensors providing data concerning the moisture profile, i.e. the moisture content of the material web throughout its surface. This data can be used as a basis for changing the adjustment devices, which then accordingly bring about the change in the moisture content of the processed material web by appropriately positioning the related slide elements 5. Of course, such slide elements 5 are provided either at all or, at the very least, at a great number of the nozzle casings 3 or the blow-out surfaces 1. In this way it is possible to act upon the material web which is located in the processing machine, typically for instance the papermaking machine, such as at the drying cylinder thereof. Additionally, there is available the possibility, with the aid of a suitable computer or microprocessor, to appropriately control the mode of operation of the slide elements. The construction of slide elements 5 shown in the drawings only constitute an exemplary embodiment. Obviously, it is possible to use different designs of opening and closing elements 4, it here being mentioned by way of example and not limitation, that there can be used in this regard valves, flap members, rotary slides and other suitable airflow-control elements.

What is important is that there is realized a possibility of acting upon the material web in a sector-like or discrete fashion at predetermined portions or locations of the material web, both along the width of the material web as well as also along the length thereof, as desired, by selectively intensifying or dosing the outflow of the blown-out drying medium.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A material web drier containing a hood drier arrangement for controlling the gas flow of a drying medium applied to a material web which is to be dried, comprising:

means coacting with said material web to be dried for infeeding a drying medium thereto;

said drying medium-infeed means containing discharge openings through which flows the drying medium for contact with the material web;

means for selectively completely freeing or partially or completely closing said discharge openings, in order to thereby selectively alter the impingement of the material web by the drying medium at discrete locations thereof, both in the lengthwise direction and also in the transverse direction of said material web; and said means for selectively completely freeing or partially or completely closing said discharge openings being structured to enable controlled impingement of the material web by the drying medium at different intensities over the width of the material web without simultaneously altering the impingement intensity of the drying medium in the lengthwise direction of the material web.

2. The material web drier as defined in claim 1, wherein:

said drying medium-infeed means comprises at least one surface means provided with said discharge openings.

3. The material web drier as defined in claim 1, wherein:

said drying medium-infeed means comprises at least one nozzle casing provided with said discharge openings.

4. A material web drier for controlling the gas flow of a drying medium onto a material web which is to be dried, comprising:

means coacting with the material web to be dried for the infeed of a drying medium thereto;

means for supplying drying medium to said drying medium-infeed means;

said drying medium-infeed means being provided with discharge openings through which flows the drying medium for contact with the material web; and opening and closing means cooperating with said discharge openings in order to selectively free or partially or completely close said discharge openings, in order to thereby selectively vary at predetermined locations of the material web, both in the lengthwise direction and in the transverse direction of said material web, the impingement of said material web by said drying medium.

5. The material web drier as defined in claim 4, wherein:

said drying medium-infeed means comprises at least one surface means provided with said discharge openings.

6. The material web drier as defined in claim 4, wherein:

said drying medium-infeed means comprises at least one nozzle casing provided with said discharge openings.

7. The material web drier as defined in claim 4, wherein:

said drying medium-infeed means comprises a plurality of nozzle casings arranged in spaced relationship from one another.

8. The material web drier as defined in claim 7, wherein:

said plurality of nozzle casings define a hood arrangement and include given ones of said nozzle casings arranged in a position other than a horizontal position; and adjustable spacer means for maintaining said slide means of said nozzle casings arranged other than in said horizontal position in spaced relation from a lower situated side wall of said related nozzle casing.

9. The material web drier as defined in claim 8, wherein:

each of said slide means is provided with a sliding shoe; and said adjustable spacer means being arranged at the region of said slide shoe.

10. The material web drier as defined in claim 4, wherein:

said drying medium-infeed means comprises at least one nozzle casing;

said opening and closing means comprising at least two elements for controlling the flow of the drying medium through said discharge openings; and means for independently adjusting the position of each of said two elements with respect to one another.

11. The material web drier as defined in claim 4, wherein:

said opening and closing means comprises slide means;

said slide means being displaceably arranged to coact with said discharge openings of said drying medium-infeed means; and said slide means being provided with a repetitive row of bores capable of coacting with at least given ones of said discharge openings in order to change the flow of drying medium through said discharge openings depending upon the position of said slide means.

12. The material web drier as defined in claim 11, wherein:

said row of bores are effective at four portions of the width of the material web.

13. The material web drier as defined in claim 11, wherein:

said row of bores contains, viewed in the direction of movement of said slide means, a large size bore followed by at least one smaller sized bore and imperforate means between said bores.

14. The material web drier as defined in claim 11, wherein:

said bores of the slide means are of the same size as the discharge openings.

15. The material web drier as defined in claim 11, wherein:

said drying medium-infeed means comprises at least one nozzle casing provided with said discharge openings;

adjustment means arranged externally of said nozzle casing for actuating said slide means; and heat retarding means provided for said adjustment means.

16. The material web drier as defined in claim 15, wherein:

said heat retarding means comprises a coacting hook element and eyelet element.

17. The material web drier as defined in claim 11, further including:

a wall located opposite said discharge openings of said drying medium-infeed means; and a slide shoe supported by spring force at said wall for pressing said slide means against said drying medium-infeed means.

18. The material web drier as defined in claim 4, wherein:

said opening and closing means being structured to be predominantly effective in a direction extending transversely with respect to the lengthwise direction of the material web.

19. A material web drier for controlling the gas flow of a drying medium onto a material web which is to be dried, comprising:

means coacting with the material web to be dried for the infeed of a drying medium thereto;

means for supplying drying medium to said drying medium-infeed means;

said drying medium-infeed means being provided with discharge openings through which flows the drying medium for contact with the material web;

opening and closing means cooperating with said discharge openings in order to selectively free or partially or completely close said discharge openings, in order to thereby selectively vary at predetermined locations of the material web, both in the lengthwise direction and in the transverse direction of said material web, the impingement of said material web by said drying medium;

said opening and closing means comprising slide means;

said slide means being displaceably arranged to coact with said discharge openings of said drying medium-infeed means;

said slide means being provided with a repetitive row of bores capable of coacting with at least given ones of said discharge openings in order to change the flow of drying medium through said discharge openings depending upon the position of said slide means;

a wall located opposite said discharge openings of said drying medium-infeed means;

a slide shoe supported by spring force at said wall for pressing said slide means against said drying medium-infeed means;

a rigid frame means for interconnecting said slide shoe and said slide means;

adjustment means for selectively positionally adjusting said slide means;

coupling means for connecting said slide means with said adjustment means;

said coupling means engaging essentially at the center of gravity of said frame means;

a rigid frame means for interconnecting said slide shoe and said slide means;

adjustment means for selectively positionally adjusting said slide means;

coupling means for connecting said slide means with said adjustment means; and said coupling means engaging essentially at the center of gravity of said frame means.

* * * * *